US006062897A

United States Patent [19]

McCarthy

[11] Patent Number: 6,062,897

[45] Date of Patent: May 16, 2000

[54] COAXIAL CABLE CONNECTOR

[75] Inventor: Dale C. McCarthy, Pensacola, Fla.

[73] Assignee: Centerpin Technology, Inc., Gulf Breeze, Fla.

[ * ] Notice: This patent is subject to a terminal disclaimer.

[21] Appl. No.: 09/038,028

[22] Filed: Mar. 11, 1998

Related U.S. Application Data

[62] Division of application No. 08/647,735, May 15, 1996, Pat. No. 5,775,934.

[51] Int. Cl.[7] ..... H01R 13/00

[52] U.S. Cl. ..... 439/427; 439/584; 439/932

[58] Field of Search ..... 439/427, 584, 439/578–583, 585, 932

[56] References Cited

U.S. PATENT DOCUMENTS

| | | | |
|---|---|---|---|
| 2,647,246 | 7/1953 | Gilbert | 439/419 |
| 2,719,957 | 7/1955 | Abbott | 439/411 |
| 2,839,595 | 6/1958 | Felts et al. . | |
| 2,887,667 | 5/1959 | Wolfe et al. . | |
| 3,317,883 | 5/1967 | Gourley et al. . | |
| 3,411,129 | 11/1968 | Peters | 439/427 |
| 3,444,507 | 5/1969 | Gerhard . | |
| 3,683,320 | 8/1972 | Woods et al. | 439/198 |
| 3,744,007 | 7/1973 | Horak | 439/394 |
| 3,860,320 | 1/1975 | Danner . | |
| 3,951,503 | 4/1976 | Caulkins . | |
| 4,013,333 | 3/1977 | Chang . | |
| 4,091,233 | 5/1978 | Berman . | |
| 4,178,054 | 12/1979 | Laudig | 439/394 |
| 4,261,632 | 4/1981 | Narozny | 439/393 |
| 4,339,166 | 7/1982 | Dayton | 439/394 |
| 4,352,240 | 10/1982 | Komada . | |
| 4,561,179 | 12/1985 | Brush, Jr. et al. | 439/391 |
| 4,696,908 | 9/1987 | Gutter et al. | 439/98 |
| 4,708,414 | 11/1987 | Lam | 439/394 |
| 4,722,579 | 2/1988 | Cummings et al | 439/391 |
| 4,739,126 | 4/1988 | Gutter et al. | 439/394 |

(List continued on next page.)

FOREIGN PATENT DOCUMENTS 0178775 4/1962 Sweden .

*Primary Examiner*—Hien Vu

*Attorney, Agent, or Firm*—Saliwanchik, Lloyd & Saliwanchik

[57] ABSTRACT

The subject invention pertains to an electrical/connector for coupling to a coaxial cable of the type having an inner conductor enclosed in an inner concentric insulation and having a generally concentric conductive sheath therearound and an outer insulation enclosing the conductive sheath. The connector has a housing having an electrically conductive portion and a bore therein. In a specific embodiment, an electrically conductive pin or prong has one end protruding axially into the housing bore and the second prong end extending in an opposite direction within a second housing bore. One or more conductive clamps are electrically connected to the conductive housing portion and insulated from the electrical conductive prong and has pointed ends sized for driving the clamp into the outer insulation and into the conductive sheath without contacting the center conductor. A housing cap has an annular wedging member for driving the conductive clamps pointed ends into the outer insulation and into the conductive sheath for making electrical contact therewith and for holding the coaxial cable within the connector. When the coaxial cable is slid into the connector, the center conductor is driven onto the conductive prong extending axially into the bore of the housing and the housing cap member is threaded onto a threaded portion of the housing so that the connector can be removed by unscrewing the cap member from the housing.

14 Claims, 2 Drawing Sheets

U.S. PATENT DOCUMENTS

| | | | |
|---|---|---|---|
| 4,759,722 | 7/1988 | Song | 439/394 |
| 4,770,642 | 9/1988 | Van Hoose | 439/127 |
| 4,786,760 | 11/1988 | Friedhelm | 439/427 |
| 4,968,268 | 11/1990 | Oh | 439/111 |
| 5,052,946 | 10/1991 | Homolka . | |
| 5,066,248 | 11/1991 | Gower, Jr. et al. | 439/578 |
| 5,263,878 | 11/1993 | Lai | 439/656 |
| 5,318,458 | 6/1994 | Thorner . | |
| 5,362,251 | 11/1994 | Bielak | 439/394 |
| 5,403,201 | 4/1995 | McCarthy . | |
| 5,503,568 | 4/1996 | Pryce | 439/427 |
| 5,569,049 | 10/1996 | Tateke et al. | 439/394 |
| 5,607,320 | 3/1997 | Wright | 439/394 |
| 5,775,934 | 7/1998 | McCarthy | 439/584 |

COAXIAL CABLE CONNECTOR

This is a division of application Ser. No. 08/647,735, filed May 15, 1996, now U.S. Pat. No. 5,775,934.

BACKGROUND OF THE INVENTION

The present invention relates to electrical connectors and especially to an electrical connector for coupling to an insulated electrical coaxial cable or wire without stripping the end of the insulated coaxial cable.

In the past, a wide variety of electrical wire connectors have been provided for connecting to wire ends. In a typical connector, the end of the wire is stripped of insulation and the bare wire is inserted into a connector where it can be soldered or clamped or otherwise attached to the connector. It is also common to tin the wire ends by coating the wire end with solder and a wide variety of connectors have been provided which removably hold the wire to the connector.

Typical connectors are seen in audio systems, such as in hi-fi speakers in which a wire end is stripped of the insulation and is inserted in an opening and a threaded nut is threaded down onto the wire, the nut can be loosened for removing the wire. Other audio speakers include spring clamps which allows a wire end to be stripped of insulation and inserted into an opening while lifting the spring connector clamp and then releasing the spring connector clamp onto the wire. Relifting of the spring connector clamp allows the removal of the wire end. Other commonly used connectors allow a stripped wire end to be inserted into a connector or into both ends of a connector and then clamped with pliers to collapse a conductive sleeve onto the wire. This type of connector can be insulated or not as desired since it is made of a malleable metal in which collapsing the conductive sleeve onto the stripped wire end provides the necessary electrical contact.

In contrast to these various types of wire connectors, the present invention deals with a wire connector that does not require the insulation to be stripped and also provides, in some embodiments, for the insertion of the insulated wire end in a manner to lock the wire end in place inside the bore of a wire connector.

Prior wire connectors can be seen in the following U.S. Patents. The Chang patent, U.S. Pat. No. 4,013,333, for a wire connector having two concentric sockets adapted to be assembled one into the other and in which the inner socket has a conductive needle mounted therein for sliding a wire end into each end of the connector and which also uses a spike pressed in two holes in the sleeves to penetrate the coating of the wire ends. In the U.S. patent to Danner, U.S. Pat. No. 3,860,320, a dangler cathode cable assembly is connected to a ball-like cathode member by stripping the end portion of the cable and inserting the end portion into a sleeve which is pressed into an undersized tapered socket and which has a pointed pin therein. In the U.S. patent to Friedhelm, U.S. Pat. No. 4,786,760, a cable connector for piezoelectric cable has an insulated cable end which is inserted into a sleeve. In the U.S. patent to Berman, U.S. Pat. No. 4,091,233, an electrical connector and a method of connecting an electrical cable to the connector is provided for connecting one or more insulated electrical cords or cables together. The insulated cable ends can be inserted into the receptacles on either end and onto a prong of electrically conductive material so that the prong is an electrical contact with the wire of an insulated cord end. A container of adhesive material on the end of the receptacle is released from the container to create a physical bond between the cord and the connector to hold the cord within the connector. In my prior U.S. Pat. No. 5,403,201 an electrical connector is coupled to an insulated electrical conductor without stripping the end of the insulated conductor. The insulated wire is held with a spring clamp which allows the wire to be released.

Other prior connectors can be seen in Homolka U.S. Pat No. 5,052,946 for a plug connector for a high voltage coaxial cable which uses a plug in contact for the connection with the central conductor. In the Komada U.S. Pat. No. 4,352,240 a method of connecting a coaxial cable to an electrical connector is provided which drives a pin shaped positive terminal into the center conductor. The S. Gerhard U.S. Pat. No. 3,444,507 is for an electrical connector for semi-solid conductors. The Caulkins U.S. Pat. No. 3,951,503 is a cable splice assembly for multiconductor cables; and the W. C. Gourley et al U.S. Pat. No. 3,317,883 is for a high voltage wire coupling having a pair of prongs for coupling to the center conductor of insulated wires.

The present invention utilizes an electrical connector for coupling to an insulated electrical coaxial cable end in which the coaxial cable is inserted into a bore in the connector housing to drive a prong into the cable end. The cable is them releasably clamped through the insulated cable with conductive clamps which extend into the conductive sheath to thereby form conductive coupling to the center conductor and separately to the concentric conductive sheaf or braiding.

SUMMARY OF THE INVENTION

An electrical connector for coupling to a coaxial cable of the type having an inner conductor enclosed in an inner concentric insulation and having a generally concentric conductive sheath therearound and an outer insulation enclosing the conductive sheath. The connector has a housing having an electrically conductive portion and a bore therein. An electrically conductive pin or prong has one end protruding axially into the housing bore and the second prong end extending in an opposite direction within a second housing bore. One or more conductive clamps are electrically connected to the conductive housing portion and insulated from the electrical conductive prong and has pointed ends sized for driving the clamp into the outer insulation and into the conductive sheath without contacting the center conductor. A housing cap has an annular wedging member for driving the conductive clamps pointed ends into the outer insulation and into the conductive sheath for making electrical contact therewith and for holding the coaxial cable within the connector. When the coaxial cable is slid into the connector, the center conductor is driven onto the conductive prong extending axially into the bore of the housing and the housing cap member is threaded onto a threaded portion of the housing so that the connector can be removed by unscrewing the cap member from the housing. The connector may be of the type for attaching to an apparatus, such as attaching an antenna of a television set. A second embodiment replaces the cap with a heat shrinkable insulation.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
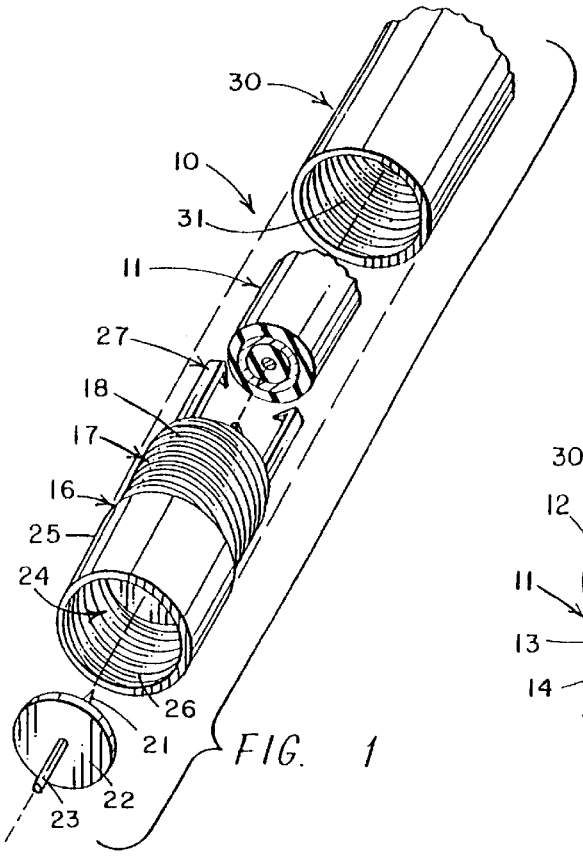
FIG. 1 is an exploded view of an electrical connector and a portion of a coaxial cable in accordance with the present invention.
Figure 2:
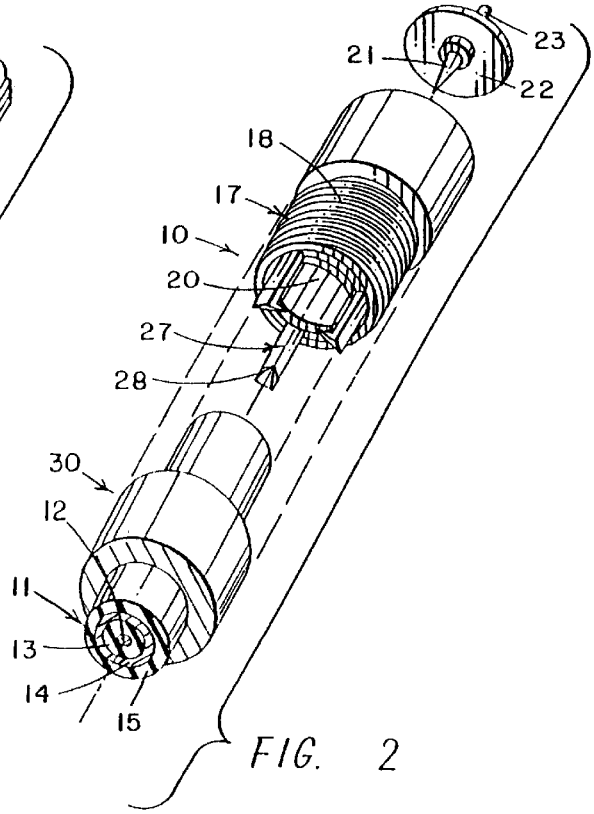
FIG. 2 is an exploded view of the electrical connector of FIG. 1 having the coaxial cable inserted into the locking cap.
Figure 3:
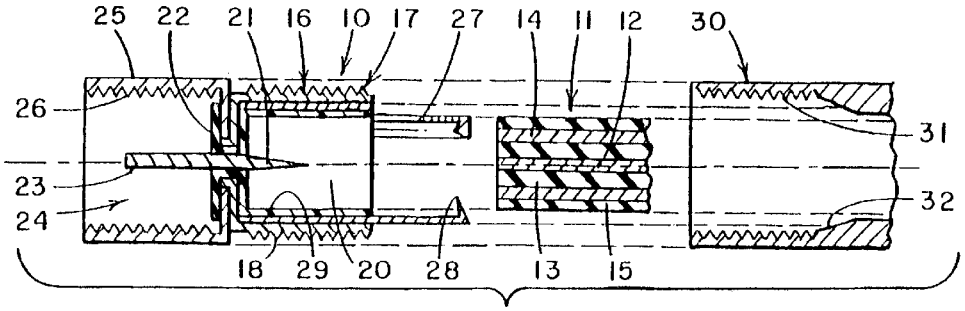
FIG. 3 is a sectional exploded view of the electrical connector of FIGS. 1 and 2.
Figure 4:
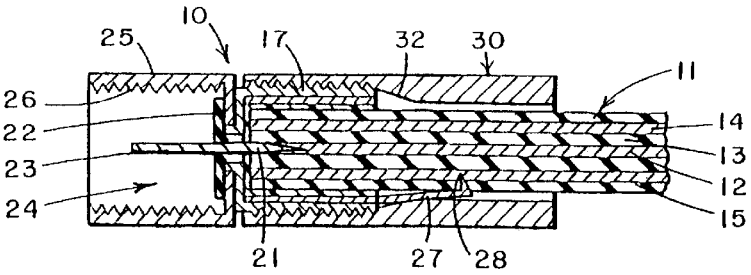
FIG. 4 is a sectional view of the electrical connector having a coaxial cable end attached thereto.

Referring to FIGS. 1–4 of the drawings, an electrical connector 10 for a coaxial cable end 11 is illustrated. The coaxial cable 11 has a center conductor 12 a concentric insulation 13; a concentric conductive wire braid or sheath 14 around the insulation 13 and an outer insulation layer 15 covering the conductive sheath 14. The connector 10 connects various types and sizes of coaxial cable to a variety of plugs, jacks, and connectors, all referred to herein as an electrical connector. Connection to the connector 10 is without solder and without stripping the insulation covers from the cable. The coaxial cable 11 may be connected to an electrical apparatus, such as a television set, and requires that the center conductor 12 be electrically coupled to another connector or apparatus and that the outer sheath 14 be connected separately but insulated from the center conductor 12. The connector 10 has a connector housing 16 having a generally cylindrical cable attaching portion 17 having external threads 18 and an internal bore 20. A connector prong or pin 21 extends axially into the bore 20 and is mounted to an insulation base 22 having a prong 23 extending therefrom. The prongs 21 and 23 are one continuous conductive member. Prong 23 extends into a bore 24 of a cylindrical housing portion 25 having internal threads 26. Electrically conductive clamps 27 have clamping or pointed tips 28 and are connected to the housing 10 electrically conductive portions 17 and 25. A plurality of clamping members 27 are contemplated even though a single clamp can perform the operation of attaching the coaxial cable end portion 11. A locking cap 30 is a generally cylindrical metal or conductive member having internal threads 31 adapted to be threadedly attached to the threads 18 of the connector body portion 17 and has an annular angled or wedging portion 32 therein. FIG. 3 also shows an insulation covering 29 which provides extra security against contact of the conductor 14 with the connector body 16 metal portions in the event a stray strand of wire from conductor 14 extended from the cable 11.

In operation, the tip of the coaxial cable 11 does not have any of the insulation stripped from the conductors as is normally required to connect a coaxial cable to a connector. The end of the coaxial cable 11 is slid between the clamping members 27 and into the bore 20 and pushed onto the prong 21 which is axially aligned with the bore 20 and with the coaxial cable to drive the prong 21 into the center conductor 12 to make an electrical conductive contact which provides the electrical continuity through the probe 23 which can then be attached to an electrical apparatus, such as a television set or the like, or to another coaxial cable. Once the coaxial cable is pushed into the bore and attached, the cap member 30 is then slid over the clamps 27 and threaded onto the threads 18 of the housing portion 17. The annular wedging portion 32 drives against the ends of the clamp 27 to drive the pointed contacts 28 into the outer insulation 15 of the coaxial cable 11. The clamps 28 are sized so as to drive through the insulating layer 15 and into the concentric conductive sheath 14 to make an electrical contact therewith. This in turn electrically connects the sheath 14 to the conductive housing 16 and further connects it to the apparatus that the connector is electrically connected to without having to strip the insulation or perform any acts of soldering the end of the coaxial cable 11. The cable is rapidly attached to the connector 10 simply by placing the cap over the cable and inserting the coaxial cable 11 in the bore and then threading the locking cap 30 onto the housing. The connector can also be removed at a later time by removing the threaded cap 30 to lift the prongs 27, which can be spring loaded so as to pull themselves back if desired, to remove the cable end 11.

Figure 5:
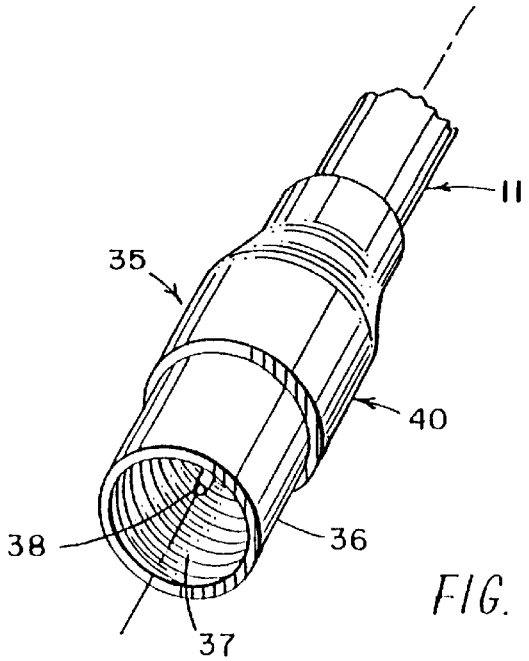
FIG. 5 is a perspective view of another embodiment of a coaxial cable connector in accordance with the present invention.
Figure 6:
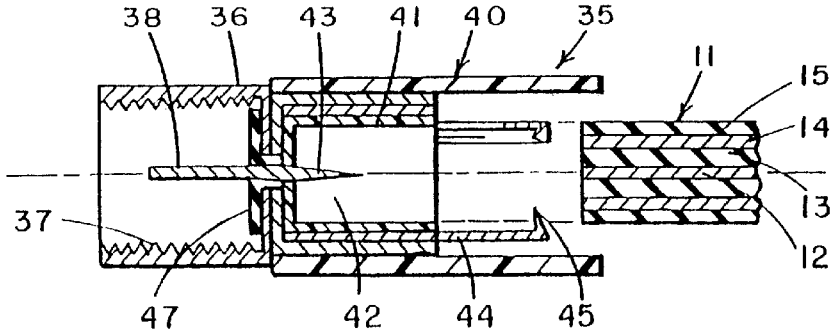
FIG. 6 is an exploded sectional view of the connection of FIG. 5.
Figure 7:
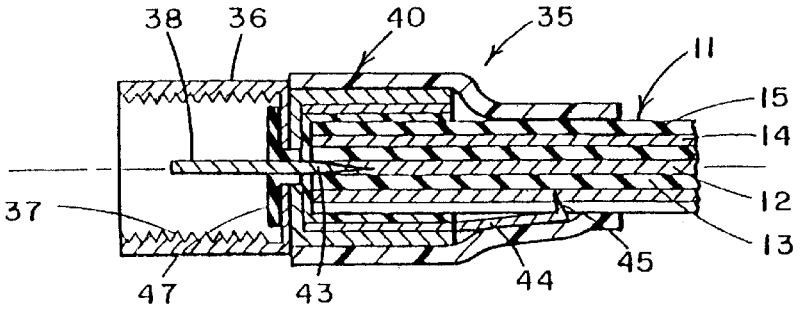
FIG. 7 is a sectional view of the embodiment of FIGS. 5 and 6 having the cable attached thereto.

Turning now to FIGS. 5, 6 and 7, another embodiment of the coaxial cable connector of FIGS. 1–4 is illustrated in which an electrical connector 35 has the connector body 36 which may be a metal body having a coaxial cable 11 attached to one end thereof. The other end of the connector has internal threads 37 with a protruding center conductor 38. In this embodiment there is attached to the one end of the connector a heat shrinkable insulating sleeve 40 which extends over and is attached to the metal connector housing portion 41. The bore 42 has the center prong 43 for insertion into or adjacent the center conductor 12 of the coaxial cable 11. A plurality of clamping extensions 44 are connected to the metal housing 41 and each has a pointed prong 45 extending from the end thereof. The center conductor 12 of coaxial cable 11 has electrical insulation 13 therearound followed by the concentric conductor or metal braid 14 which in turn is wrapped in insulation 15. In operation, the coaxial cable 11 end is inserted into the opening 42 between the clamping members 44 and 45 and onto the prong 43 which is driven into or directly adjacent to the center conductor 12.

Center conductor 12 in a coaxial cable sometimes a single conductor wire and sometimes is formed of multiple strands so that the prong 43 will sometimes be driven into the multiple strand wire and at other times be directed adjacent to the single wire conductor 12. Once the cable 11 is inserted and attached to the prong, the heat shrinkable insulation 40 is heated which causes it to shrink onto the cable 11 and onto the clamps 44 to push the clamps and the pointed prongs 45 into the outer insulation 15 of the cable 11 where the prongs pass therethrough and contact the conductor member 15. To assure proper contact, the insulation 40 can be pressed down with the finger to press onto the clamp members 44 to properly set the prongs 45 into the insulation 15 and into the conductor 14. The insulating sleeve 40 thus holds the connector 35 to the cable 11 while forming an insulation for the tip of the cable. The clamps 44 also lock into the insulation 15 to hold the cable in place with the center prong 43 making contact with the conductor 12 of the cable and thus providing the center conductor 38 contact with the cable 11. The prongs 38 and 43 are mounted to an insulating member 47, which is attached to the body 36. By replacing the cap 30 of FIGS. 1–4 with the heat shrinkable insulation 40, the cable 11 is given more flexibility and gives an insulated cover between the connection of the cable and the connector.

It should be clear at this time that an electrical connector for a coaxial cable has been provided which advantageously allows the coaxial cable to be attached to the connector without stripping or removing any of the insulation on the end of the cable to give a complete electrical connection to the center conductor and the conductive grounding sheath. However, the present invention is not to be considered as limited to the forms shown which are to be considered illustrative rather than restrictive.

I claim:

1. An electrical connector for coupling to an electrical conductor of the type having an inner conductor enclosed with an inner insulation and a generally concentric conductive sheath around said inner insulation and enclosed in an outer insulation, said electrical connector comprising:

a housing having an electrically conductive portion and a bore therein;

at least one electrically conductive prong having two end portions, said conductive prong attached to said housing and having an end portion protruding axially into said housing bore for receiving the electrical conductor;

an electrically conductive clamp electrically connected to said electrically conductive portion of said housing and insulated from said electrically conductive prong, said electrically conductive clamp having an pointed end sized for driving through the outer insulation of the electrical conductor and into the conductive sheath without contacting the inner conductor;

an insulating tube sleeve attached to said housing and extending over said electrically conductive clamp and said sleeve having an opening to receive the electrical conductor therethrough, said insulating sleeve being adapted to be heat shrinked to thereby compress said electrically conductive clamp through the outer insulation of the electrical conductor and into the conductive sheath to thereby form a conductive path between the conductive sheath and the electrically conductive portion of said housing.

2. An electrical connector for coupling to an electrical conductor in accordance with claim 1 in which said insulated sleeve is a heat shrinkable sleeve which shrinks onto said cable and electrical conductive prong when heated.

3. An electrical connector for coupling to an electrical conductor in accordance with claim 2 in which said sleeve is a generally cylindrical hollow sleeve attached to said housing and extending therefrom.

4. An electrical connector for coupling to an electrical conductor in accordance with claim 3 in which said electrical connector has a plurality of electrically conductive clamps.

5. An electrical connector for coupling to an electrical conductor in accordance with claim 4 in which said electrically conductive prong is attached to the housing through an electrically insulated housing portion.

6. An electrical connector for coupling to an electrical conductor in accordance with claim 5 in which said housing has two bores and said electrically conductive prong has a second end portion extending into said second housing bore.

7. An electrical connector for coupling to an electrical conductor in accordance with claim 1 in which said housing bore has an electrically insulating lining therein.

8. The method of coupling an electrical connector to a coaxial cable of the type having an inner conductor enclosed with an inner insulation and a conductive sheath around the inner insulation and enclosed in an outer insulation wherein:

the electrical connector includes;

a housing having an electrically conductive portion and a bore portion;

at least one electrically conductive prong, said conductive prong attached to said housing such as to be electrically isolated from said electrically conductive housing portion and protruding axially into said housing bore for contacting the inner conductor of the electrical conductor;

an electrically conductive clamp electrically connected to said electrically conductive housing portion and insulated from said electrically conductive prong, said electrically conductive clamp having a pointed end adapted for driving into an outer insulation of the electrical conductor and into the conductive sheath of the electrical conductor without contacting the inner conductor; and a closure member made up of heat shrink sleeve having an aperture for receiving a coaxial cable and being of a dimension to fit over the electrical conductive clamp and the housing to maintain the clamp in contact with the conductive sheath of the cable;

said method comprising the following steps:

a. inserting the coaxial cable through the aperture in the closure member;

b. threading the coaxial cable past the electrical conductive clamp and into electrical conductive engagement at the inner conductor with the end of the electrically conductive prong protruding into the housing bore;

c. driving the pointed end of the electrical conductive clamp through the outer insulation and into the conductive sheath of the coaxial cable; and d. placing the heat shrink sleeve over the housing and conductive clamp and cable and heating the same so as to shrink and securely attach the sleeve to the housing, conductive clamp and cable and to maintain the conductive clamp in contact with the conductive sheath through the outer insulation of the coaxial cable;

whereby the coaxial cable is secured in place with the connector and electrical contact is made with the cable at the inner conductor and at the conductive sheath.

9. An electrical connector for coupling to an electrical conductor of the type having an inner conductor enclosed with an inner insulation and a generally concentric conductive sheath around said inner insulation and enclosed in an outer insulation, said electrical connector comprising:

a housing having an electrically conductive portion and a bore therein;

at least one electrically conductive prong, said conductive prong attached to said housing such as to be electrically isolated from said electrically conductive housing portion and protruding axially into said housing bore for contacting the inner conductor of the electrical conductor;

an electrically conductive clamp electrically connected to said electrically conductive housing portion and insulated from said electrically conductive prong, said electrically conductive clamp having a pointed end adapted for driving into an outer insulation of the electrical conductor and into the conductive sheath of the electrical conductor without contacting the inner conductor;

an insulating tube sleeve overlying said housing and extending over said electrically conductive clamp and shaped to receive the electrical conductor therethrough, wherein said insulated sleeve is a heat shrinkable sleeve which shrinks onto said cable and electrically conductive clamp when heated.

10. The electrical connector according to claim 9, wherein said insulating sleeve is adapted to compress said electrically conductive clamp into the outer insulation and into the conductive sheath to thereby form a conductive path between the conductive sheath and the electrically conductive housing portion.

11. The electrical connector according to claim 9, wherein said sleeve is a generally cylindrical hollow sleeve attached to said housing and extending therefrom.

12. The electrical connector according to claim 9, wherein said electrical connector comprises a plurality of electrically conductive clamps.

13. The electrical connector according to claim 9, wherein said electrically conductive prong is attached to the housing through an electrically insulating housing portion.

14. The electrical connector according to claim 9, wherein said housing bore has an electrically insulating lining therein.

* * * * *

UNITED STATES PATENT AND TRADEMARK OFFICE

CERTIFICATE OF CORRECTION

PATENT NO. : 6,062,897
DATED : May 16, 2000
INVENTOR(S) : Dale C. McCarthy

It is certified that error appears in the above-identified patent and that said Letters Patent is hereby corrected as shown below:

Title page, [57] Abstract: "electrical/connector" should read --electrical connector--.

Column 4,
Line 22: "a coaxial cable" should read --a piece of coaxial cable--.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*